United States Patent [19]

Sasaki et al.

[11] Patent Number: 4,513,569

[45] Date of Patent: Apr. 30, 1985

[54] COMBUSTION LINER SUPPORT FOR COMBUSTION APPARATUS

[75] Inventors: Masafumi Sasaki, Zushi; Susumu Kashiwagi; Takanori Hiyoshi, both of Yokosuka, all of Japan

[73] Assignee: Nissan Motor Company, Limited, Yokohama, Japan

[21] Appl. No.: 464,482

[22] Filed: Feb. 7, 1983

[30] Foreign Application Priority Data

Feb. 15, 1982 [JP] Japan ..... 57-21316

[51] Int. Cl.[3] ..... F02C 7/20

[52] U.S. Cl. ..... 60/39.31; 60/39.32; 60/748; 285/402

[58] Field of Search ..... 60/39.31, 39.32, 748, 60/753; 285/376, 401, 402

[56] References Cited

U.S. PATENT DOCUMENTS

| | | | |
|---|---|---|---|
| 1,430,558 | 10/1922 | Jimerson | 285/376 |
| 3,098,357 | 7/1963 | Marsh | 285/402 |
| 3,911,672 | 10/1975 | Irwin | 60/39.32 |
| 3,990,231 | 9/1976 | Irwin | 60/39.32 |
| 4,074,520 | 2/1978 | Mansson et al. | 60/39.32 |

FOREIGN PATENT DOCUMENTS

| | | |
|---|---|---|
| 2232286 | 1/1973 | Fed. Rep. of Germany . |
| 7312457 | 4/1973 | Fed. Rep. of Germany . |
| 2633387 | 2/1977 | Fed. Rep. of Germany . |

OTHER PUBLICATIONS

"Huette des Ingenieurs Taschenbuch", Berlin 1960, 28th Ed., pp. 832–833.

*Primary Examiner*—Louis J. Casaregola
*Assistant Examiner*—Timothy S. Thorpe
*Attorney, Agent, or Firm*—Schwartz, Jeffery, Schwaab, Mack, Blumenthal & Koch

[57] ABSTRACT

An upstream end of a combustion liner is adapted to be firmly clamped between an end of a supporting bracket and a pusher ring under the bias of a spring. Constructions and arrangements are made so as to enable the supporting bracket to be of one-piece. Various embodiments include a bayonet type, a threaded type, and an annular type attachment means.

5 Claims, 6 Drawing Figures

COMBUSTION LINER SUPPORT FOR COMBUSTION APPARATUS

BACKGROUND OF THE INVENTION

1. Field of the Invention

The present invention relates to a combustion liner support for use in a combustion apparatus as for a gas turbine engine.

2. Description of the Prior Art

In a typical gas turbine combustion apparatus, a combustion liner, that defines therein a combustion chamber, is installed in a combustion outer casing in a manner to cooperate therewith to define an annular air conduit through which air is supplied under pressure into the combustion chamber for combustion of fuel. Various combustion liner support structures have been proposed but there is none that is satisfactory both in cost and durability. With the prior art support structures, the combustion liner is mounted rigidly on the combustor outer casing.

SUMMARY OF THE INVENTION

In accordance with the present invention, there is proposed an improved combustion liner support for a combustion apparatus. The combustion liner support comprises means for providing an outward projection to an annular axial end of a combustion liner, an annular supporting bracket encircling a fuel injection nozzle attached to a combustion liner outer casing and having an end secured to the combustion liner outer casing and the other end receiving therein the combustion liner end, means for providing an inward projection to the other end of the annular supporting bracket, a pusher ring cooperating with the supporting bracket inward projection to interpose therebetween a combustion liner outward projection, and biasing means for resiliently urging the pusher ring against the supporting bracket inward projection so that the combustion liner is resiliently supported on the combustion liner outer casing, in which the supporting bracket is of one piece.

The above structure makes it possible to form the supporting bracket from ceramic while the combustion liner from ordinary metal and provides an excellent combustion liner support that is satisfactory both in cost and durability.

It is accordingly an object of the present invention to provide a combustion liner support for a combustion apparatus that is satisfactory both in cost and durability.

It is another object of the present invention to provide a combustion liner support of the above-described character that is adapted to resiliently support the combustion liner relative to the combustion liner outer casing.

It is a further object of the present invention to provide a combustion liner support of the above-described character that makes it possible to form the supporting bracket from ceramic while the combustion liner from ordinary metal.

It is a still further object of the present invention to provide a combustion liner support of the above described character that is particularly suited for adoption in an automotive gas turbine engine.

BRIEF DESCRIPTION OF THE DRAWINGS

The features and advantages of the combustion liner support according to the present invention will become more clearly appreciated from the following description taken in conjunction with the accompanying drawings, in which like reference characters designate like or corresponding parts in the several views and wherein.

DESCRIPTION OF THE PREFERRED EMBODIMENTS

Figure 1:
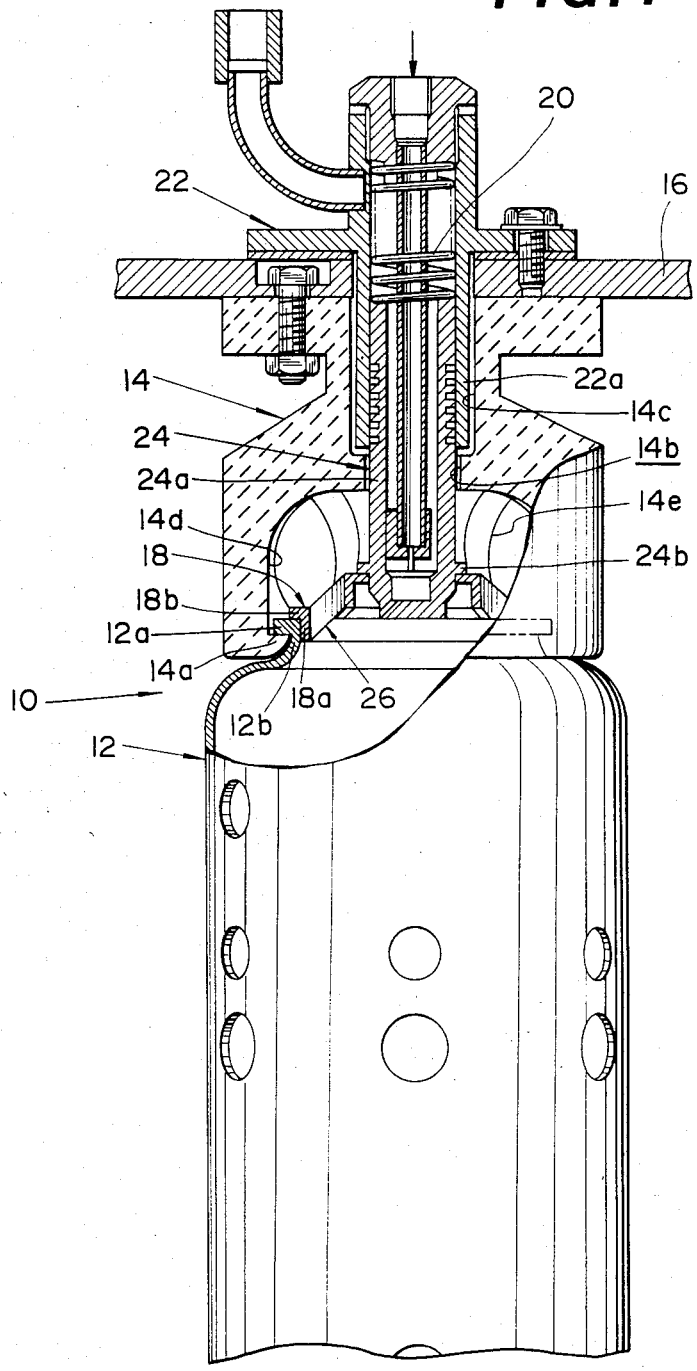
FIG. 1 is an axially sectional view of a support adapted to resiliently support a combustion liner.

For better understanding of this invention, reference is first made to FIG. 1 which shows a combustion apparatus adapted for adoption in a gas turbine engine and having a combustion liner support operative to effect a resilient supporting action. The structure shown in FIG. 1 is similar to those disclosed in Japanese Patent Application No. 56-12904 and Japanese Utility Model Application No. 56-1472202, both of which have been assigned to the same assignee as the subject application, but not applicable to the present invention as a prior art under the Patent Law.

In FIG. 1, the combustion liner is generally indicated by 10 and shown as comprising an annular outward flange 12*a* provided to the upstream end of a generally cylindrical combustion liner 12, a plurality of brackets 14 bolted to or otherwise secured at an end to an upstream end of a generally cylindrical combustion outer casing 16 and cooperative to form at the other end an annular inward finger 14*a* engaging the combustion liner outward flange 12*a*, a pusher ring 18 cooperating with the bracket finger 14*a* to clamp therebetween the combustion liner outward flange 12*a*, and a spring 20 urging the pusher ring 18 against the bracket finger 14*a*.

More specifically, the combustion liner 12 is arranged concentrically within the outer casing 16 to define therebetween an annular air conduit through which air is supplied under pressure into the combustion chamber defined by the combustion liner 12 for combustion of fuel. The combustion liner 12 is reduced in diameter at the upstream end to have a smaller diameter portion 12*b* from which the foregoing flange 12*a* extends radially outwardly. The flange 12*a* and smaller diameter portion 12*b* are coaxially or concentrically arranged with respect to the axis of the combustion liner 12. The brackets 14 are joined to form an annular shape with a central opening 14*b* including a smaller bore portion 14*c* and a larger bore portion 14*d* located nearer to the combustion liner 12 than the smaller bore portion 14*c*. A nozzle holder 22 secured to the outer casing 16 has a sleeve 22*a* received in the bracket smaller bore portion 14*c* to hold therein a fuel injection nozzle 24 that partially protrudes from the holder 22 into the bracket larger bore portion 14*d*. The fuel injection nozzle 24 includes a slidable outer sleeve 24*a* slidably received in the nozzle holder 22. The injection nozzle outer sleeve 24*a* has a rim 24*b* adjacent the combustion liner side end thereof. A swirler 26 of annular configuration is disposed in the bracket larger bore portion 14*d* and fitted on the combustion liner side end of the injection nozzle outer sleeve 24*a* in a manner to abut at the inner peripheral portion thereof onto the rim 24*b* so that it is movable together with the injection nozzle outer sleeve 24*a*. The swirler 26 also has at the outer periphery thereof an integral flanged wall portion that constitutes the foregoing pusher ring 18. The pusher ring 18 consists of a cylindrical body portion 18*a* and an annular flange portion 18*b* extending radially outwardly. The cylindrical body portion 18*a* is adapted to fit in the combustion liner smaller diameter portion 12*b* for thereby aligning the combustion liner 12 with the fuel injection nozzle 24. The pusher ring flange portion 18*b* cooperates with the bracket finger 14*a* to firmly clamp therebetween the combustion liner 12 under the bias of the spring 20. The spring 20 is a compression coil spring and disposed within the nozzle holder 22 in a manner to constantly urge the fuel injection nozzle outer sleeve 24*a* in the direction projecting from the nozzle holder 22, thereby allowing the pusher ring 18 to be pressed against the combustion liner flange 12*a*.

The brackets 14 further have a plurality of air inlets 14*e* through which air under pressure is supplied further through the swirler 26 into the combustion chamber defined by the combustion liner 12 for combustion of fuel injected from the fuel injection nozzle 24.

From the foregoing, it is to be understood that the combustion liner support 10 is adapted to effect a resilient supporting action, i.e., adapted to resiliently hold the combustion liner 12 relative to the combustion outer casing 16. This structure is quite advantageous since it is not substantially affected by the expansion or contraction of the combustion liner 12 and other associated parts and makes it possible to form the brackets 14 from ceramic while the combustion liner 12 from ordinary metal. When the brackets 14 are formed from ceramic while the combustion liner 12 from metal, there will be a large difference in thermal expansion therebetween. The above support structure 10 is not affected at all by such a difference in thermal expansion therebetween. The above support structure 10 is not affected at all by such a difference in thermal expansion that will otherwise cause a crack or cracks in the ceramic brackets 14.

The above combustion liner support, however, is costly both in manufacture and assembly since it requires a plurality of separate or independent brackets. This is particularly true when the brackets are made of ceramic.

Figure 2:
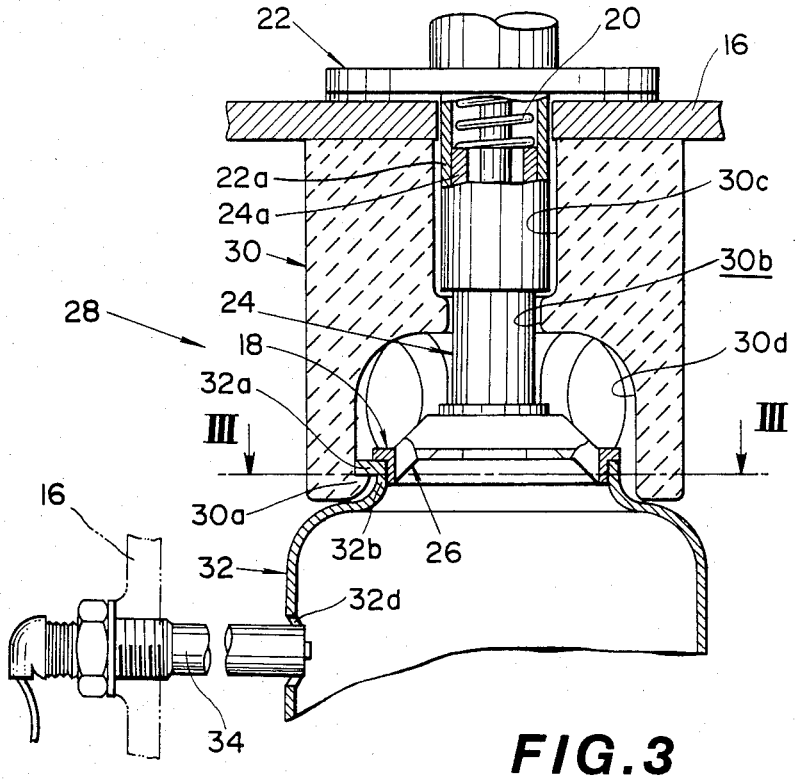
FIG. 2 is a view similar to FIG. 1, though some parts and portions are broken away, but shows a combustion liner support according to an embodiment of the present invention.
Figure 3:
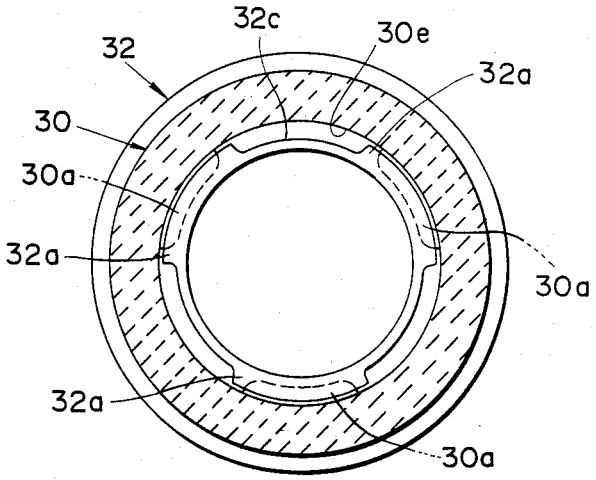
FIG. 3 is a cross-sectional view taken along the line III—III of FIG. 2.

Referring now to FIGS. 2 and 3, a combustion liner support according to an embodiment of the present invention is generally indicated by 28 and comprises a one-piece annular ceramic bracket 30 having at the combustion liner side end thereof a plurality of arcuated inward fingers 30*a* forming part of a common annular shape and arranged with equal intervals or equal arcuated notches 30*e*. In this embodiment, the supporting bracket 30 is formed with three inward fingers 30*a* and three notches 30*e*. Similarly to the supporting brackets 14 of FIG. 1, the supporting bracket 30 is bolted to or otherwise secured to the combustion outer casing 16 and has a central opening 30*b* including a smaller bore portion 30*c* and a larger bore portion 30*d*.

A combustion liner 32 has at the upstream end thereof a smaller diameter portion 32*b* and a plurality of arcuate outward flanges 32*a* corresponding in number to the bracket fingers 30*a*. The combustion liner flanges 32*a* form part of a common annular shape and are arranged with equal intervals or equal arcuated notches 32*c*. The above flanges and fingers are so constructed and arranged that the combustion liner flanges 32*a* are insertable through bracket notches 30*e* into the larger bore portion 30*d* of the bracket central opening 30*b*.

In installation, the combustion liner flanges 32*a* are first inserted into the bracket notches 30*e* to abut on the pusher ring 18. The combustion liner 32 is then pushed against the pusher ring 18 so that the combustion liner flanges 32*a* are moved together with the pusher ring 18 into the larger bore portion 30*d* of the bracket centeral opening 30*b*, prevailing against the bias of the spring 20. The combustion liner 32 is then rotated a predetermined angle and relieved from the pushing force so that the combustion liner flanges 32*a* are firmly clamped between the pusher ring 18 and the bracket fingers 30*a* under the bias of the spring 20.

The combustion liner 32 is also formed with a plug hole 32*d* into which an ignition plug 34 is inserted at an end thereof. The ignition plug 34 is secured at the other end thereof to the combustion liner outer casing 16 and therefore serves as a stopper that prevents the combustion liner 32 from being rotated relative to the bracket 30 due to the vibrations and disengaged from the bracket fingers 30*a*.

From the foregoing, it will be understood that the combustion liner support 28 of this invention is operative to effect a coupling action like a bayonet coupling, i.e., the combustion liner 32 is easily installed in a bayonet coupling-like manner.

It will be further understood that the foregoing structure makes it possible to attain a single piece supporting bracket, considerably reducing an assembling cost as well as a manufacturing cost.

Figure 4:
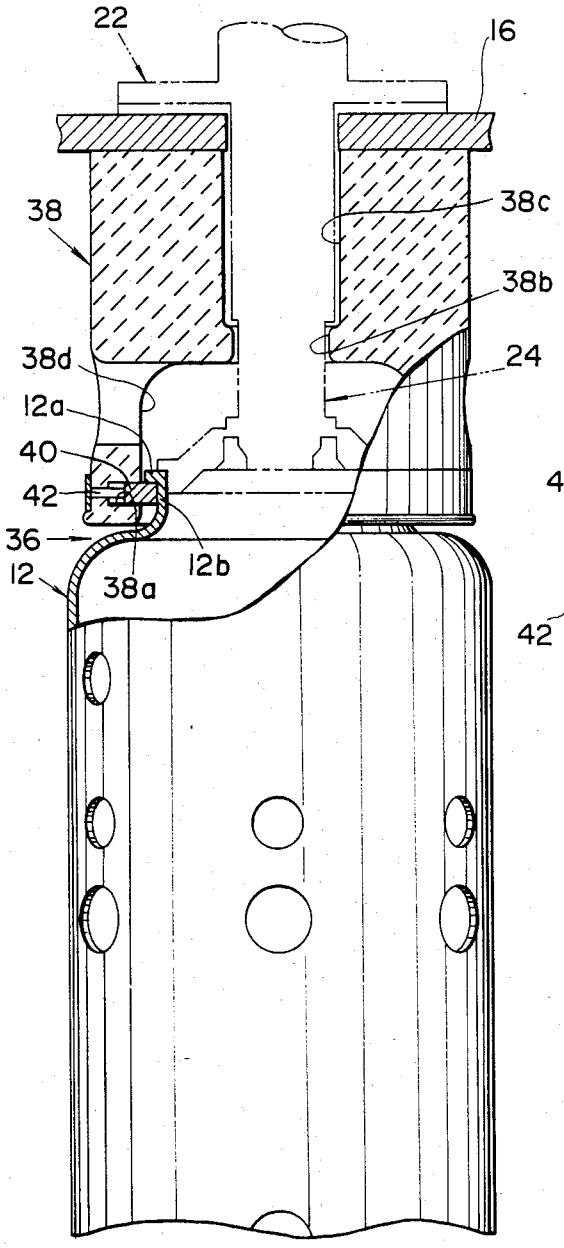
FIG. 4 is a view similar to FIG. 1, though some parts and portions are broken away, but shows a combustion liner support according to another embodiment of the present invention.
Figure 5:
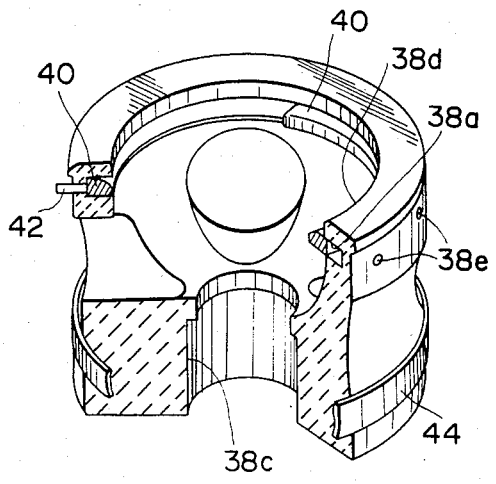
FIG. 5 is a perspective view, partly cutaway, of a combustion liner supporting brackets and its associated parts utilized in the support of FIG. 4.

Referring to FIGS. 4 and 5, a combustion liner support according to a modified embodiment of this invention is generally indicated at 36 and shown as comprising a one-piece ceramic supporting bracket 38 having at the combustion liner side end thereof a concentric annular groove 38*a* of rectangular cross section. A plurality of arcuated fingers 40 each forming part of a common annular shape are fitted in the groove 38*a* in a manner to be movable radially of the bracket 38. The bracket 38 is also formed with a plurality of radial openings 38*e* that establish communication between the groove 38*a* and the outside of the bracket 38, i.e., that allows access to the fingers 40 from the outside of the bracket 38. Each radial opening 38*e* has received therein a push rod 42 operative to move the matching finger 40 radially inwardly of the bracket 38. The push rods 42 and fingers 40 are so constructed and arranged that when the push rods are arranged to have their outside ends substantially flush with the outer surface of the bracket 38, the fingers 40 protrude from the inner wall of the bracket 38 while being joined together to form an annular shape. Similarly to the brackets 14 of FIG. 1, the bracket 38 is bolted to or otherwise secured to the combustion outer casing 16 and has a central opening 38*b* including a smaller bore portion 38*c* and a larger bore portion 38*d*.

In installation, the fingers 40 are arranged deeply inside the groove 38*a* to allow the insertion of the combustion liner flange 12*a* into the larger bore portion 38*d* of the bracket central opening 38*b*. The fingers 40 are then pushed by the push rods 42 to protrude from the groove 38*a* and placed around the smaller diameter portion 12*b* of the combustion liner 12 as shown in FIG. 4. The combustion liner flange 12*a* is thus firmly clamped between the pusher ring 18 and the fingers 40 under the bias of the spring 20, not shown in FIG. 4.

A circular band 44 is placed around the bracket 38 to cover the radial openings 38*e* and thereby prevent the push rods 42 from protruding outside of the radial openings.

This embodiment can produce substantially the same effect as the previous embodiment.

Figure 6:
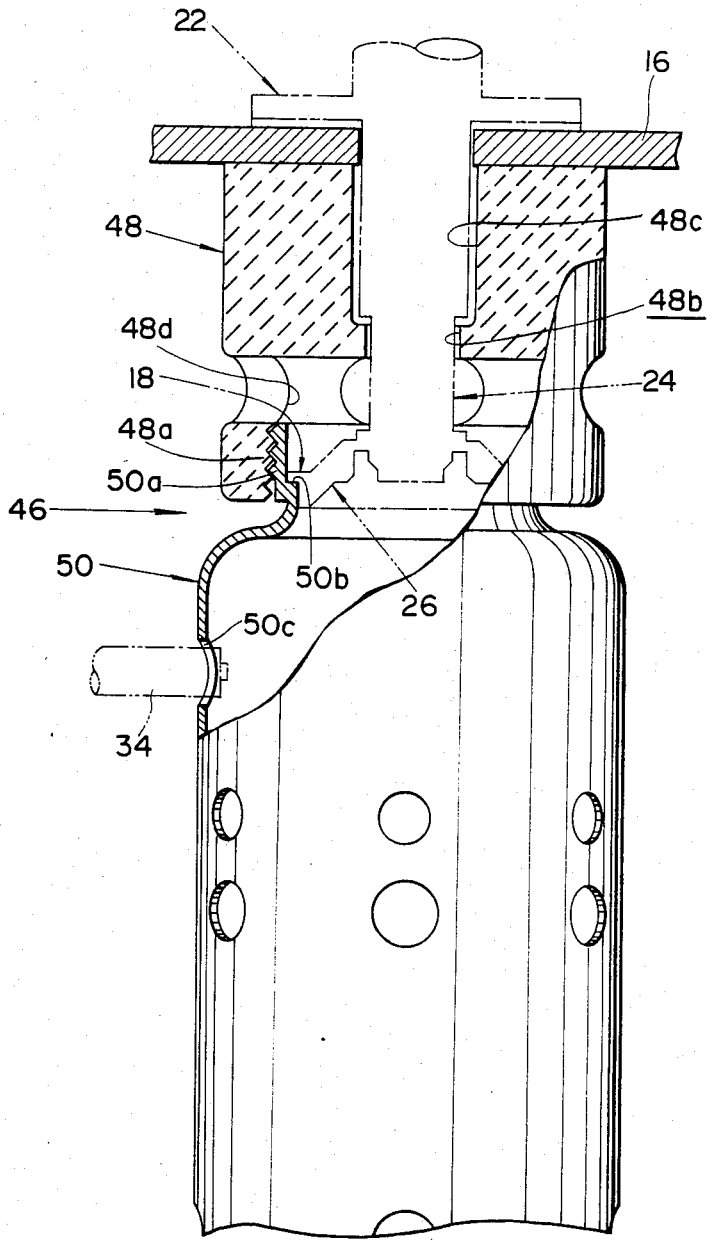
FIG. 6 is a view similar to FIG. 1, though some parts and portions are broken away, but shows a combustion liner support according to a further embodiment of the present invention.

Referring to FIG. 6, a combustion liner support according to a further modified embodiment of this invention is generally indicated by 46 and shown as comprising a one-piece supporting bracket 48 having at the combustion liner side end thereof an internally threaded cylindrical wall portion 48*a*. Similarly to the brackets 14 of FIG. 1, the supporting bracket 48 is bolted to or otherwise secured to the combustion outer casing 16 and has a central opening 48*b* including a smaller bore portion 48*c* and a larger bore portion 48*d*.

A combustion liner 50 is reduced in diameter at the upstream end to have an externally threaded smaller diameter portion 50*a* adapted to be screwed into the internally threaded cylindrical wall portion 48*a*. In this instance, it is to be noted that the threads in the bracket wall portion 48*a* and combustion liner smaller diameter portion 50*a* are not so formed as to tightly and fittingly engage with each other but to be firmly pressed at their matching thread surfaces against each other under the bias of the spring 20 for thereby allowing the combustion liner 50 to be resiliently supported on the supporting bracket 48. To this end, the combustion liner 50 has at the smaller diameter portion 50*a* an annular inward shoulder 50*b* with which the pusher ring 18 is abuttingly engaged.

The combustion liner 50 is also formed with a plug hole 50*c* into which the ignition plug 34 is inserted at an end thereof and prevented from being rotated relative to the supporting bracket 48.

This embodiment can produce substantially the same effect as the previous embodiments.

Obviously, numerous modifications and variations of the present invention are possible in light of the above teachings. It is therefore to be understood that within the scope of the appended claims, the invention may be practiced otherwise than as specifically described herein.

What is claimed is:

1. A combustion liner support for a combustion apparatus having a combustion outer casing and a fuel injection nozzle attached thereto, comprising:

a one-piece annular support bracket encircling said fuel injection nozzle and having an end secured to said combustion outer casing and the other end receiving therein an annular axial end of a combustion liner;

means for providing a plurality of outward projections to said combustion liner end;

means for providing a plurality of inward projections to said other end of said annular supporting bracket;

said combustion liner outward projections being releasably engageable with said supporting bracket inward projections when said combustion liner is inserted into said other end of said support bracket;

a pusher ring cooperating with said supporting bracket inward projections to interpose therebetween said combustion liner outward projections; and biasing means for resiliently urging said pusher ring against said supporting bracket inward projections so that said combustion liner is resiliently supported on said combustion liner outer casing;

in which said fuel injection nozzle includes a slidable outer sleeve slidably received in a nozzle holder attached to said combustion outer casing, said injection nozzle outer sleeve has a rim adjacent the combustion liner side end thereof, said combustion apparatus further including a swirler of annular configuration fitted on said combustion liner side end of said injection nozzle outer sleeve in a manner to abut at the inner peripheral portion thereof onto said rim to that it is movable together with said injection nozzle outer sleeve, and in which said pusher ring is provided to the outer periphery of said swirler and formed integral therewith, said pusher ring being in the form of having a cylindrical body portion and an annular flange portion extending radially outwardly.

2. A combustion liner support as set forth in claim 1, in which said supporting bracket inward projections comprise a plurality of arcuated fingers formed integral with said supporting bracket and projecting radially inwardly thereof, said fingers forming part of a common annular shape and arranged with equal spaces, and in which said combustion liner outward projections comprise a plurality of arcuated flanges corresponding in number to said supporting bracket fingers and formed integral with said combustion liner, said combustion liner flanges forming part of a common annular shape and being arranged with equal spaces so that said combustion liner flanges are inserted into said supporting bracket through said bracket spaces and brought into abutting engagement with said bracket fingers by rotating said combustion liner a predetermined angle relative to said supporting bracket.

3. A combustion liner support as set forth in claim 1, in which said supporting bracket inward projections comprise a plurality of arcuated fingers each forming part of a common annular shape, said inward projections providing means also comprising an annular groove formed in said supporting bracket at said other end thereof and a plurality of radial openings formed in said supporting bracket to establish communication between said groove and the outside of said supporting bracket, said arcuated flanges forming part of a common annular shape and being fitted in said groove in a manner to be movable radially of said supporting bracket, said inward projections providing means further comprising a plurality of push rods received in said radial openings and movable to cause said fingers to project from said radial openings and an annular band placed around said bracket to cover said radial openings and thereby prevent said push rods from protruding outside of said radial openings, said fingers being adapted to form an annular finger fittingly encircling said combustion liner annular axial end when kept protruded by said fingers and said annular band.

4. A combustion liner support as set forth in claim 1, in which said supporting bracket inward projections comprise internal threads formed in the inner wall portion at said other end of said supporting bracket, and in which said combustion liner outward projections comprise external threads formed in the outer wall portion at said axial end of said combustion liner, said combustion liner further having at said axial end an inward shoulder upon which said pusher ring abuts, said supporting bracket internal threads and said combustion liner external threads being pressed against each other at their matching thread surfaces under the bias of said biasing means.

5. A combustion liner support as set forth in claim 1, in which said supporting bracket is made of ceramic.

* * * * *